US009004189B2

(12) United States Patent
Zlatintsis

(10) Patent No.: US 9,004,189 B2
(45) Date of Patent: Apr. 14, 2015

(54) PROTECTIVE DEVICE HAVING A PRESSURE TANK

(75) Inventor: Chrysafis Zlatintsis, Lübeck (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 513 days.

(21) Appl. No.: 13/397,850

(22) Filed: Feb. 16, 2012

(65) Prior Publication Data

US 2012/0211246 A1 Aug. 23, 2012

(30) Foreign Application Priority Data

Feb. 17, 2011 (EP) ..... 11154781

(51) Int. Cl.

| | |
|---|---|
| ***A62C 13/00*** | (2006.01) |
| ***A62C 35/58*** | (2006.01) |
| ***A62C 13/66*** | (2006.01) |
| ***A62C 13/76*** | (2006.01) |

(52) U.S. Cl.

CPC ..... *A62C 13/66* (2013.01); *A62C 13/76* (2013.01)

(58) Field of Classification Search

CPC ..... A62C 3/07; A62C 5/023; A62C 13/66; A62C 13/68

USPC ..... 169/9, 62, 72, 73, 85

See application file for complete search history.

(56) References Cited

U.S. PATENT DOCUMENTS

| | | | | |
|---|---|---|---|---|
| 3,974,945 | A | 8/1976 | Burger | |
| 4,889,189 | A * | 12/1989 | Roznieck | 169/73 |
| 5,063,998 | A * | 11/1991 | Quinn | 169/65 |
| 5,984,016 | A | 11/1999 | Samuelsson | |
| 6,394,188 | B1 * | 5/2002 | Zwergel | 169/85 |
| 7,987,940 | B2 * | 8/2011 | Bryson et al. | 180/305 |
| 8,322,452 | B2 * | 12/2012 | Fabre | 169/9 |

FOREIGN PATENT DOCUMENTS

| | | | |
|---|---|---|---|
| DE | 946684 | C | 8/1956 |
| DE | 2431455 | A1 | 1/1976 |
| DE | 2838341 | A1 | 3/1980 |
| DE | 10229011 | A1 | 1/2004 |
| EP | 1500412 | A1 | 1/2005 |
| WO | 9813292 | A1 | 4/1998 |

* cited by examiner

*Primary Examiner* — Ryan Reis
(74) *Attorney, Agent, or Firm* — Harness, Dickey & Pierce, P.L.C.

(57) ABSTRACT

A protective device with a pressure tank (1) includes an elastic extinguishing agent balloon (3) filled with an extinguishing agent (23) and a propellant, where the elastic extinguishing agent balloon (3) borders onto at least one elastic component (32) and this elastic component is fluid permeable. The upper part of the elastic extinguishing agent balloon (3) is formed as a sealing ring. The device has the advantage that when it is used in mobile and stationary objects, where vibrations and other forces act on the extinguishing device, a high degree of operational safety of the extinguishing device can be assumed, that makes it possible to discharge almost 100 percent of the extinguishing agent without any malfunctioning. The operation of the extinguishing device is also temperature independent so that no additional safety measures are required in the case of a change in the spatial attitude of the pressure tank.

10 Claims, 9 Drawing Sheets

PROTECTIVE DEVICE HAVING A PRESSURE TANK

CROSS-REFERENCE TO RELATED APPLICATIONS

Figure 1:
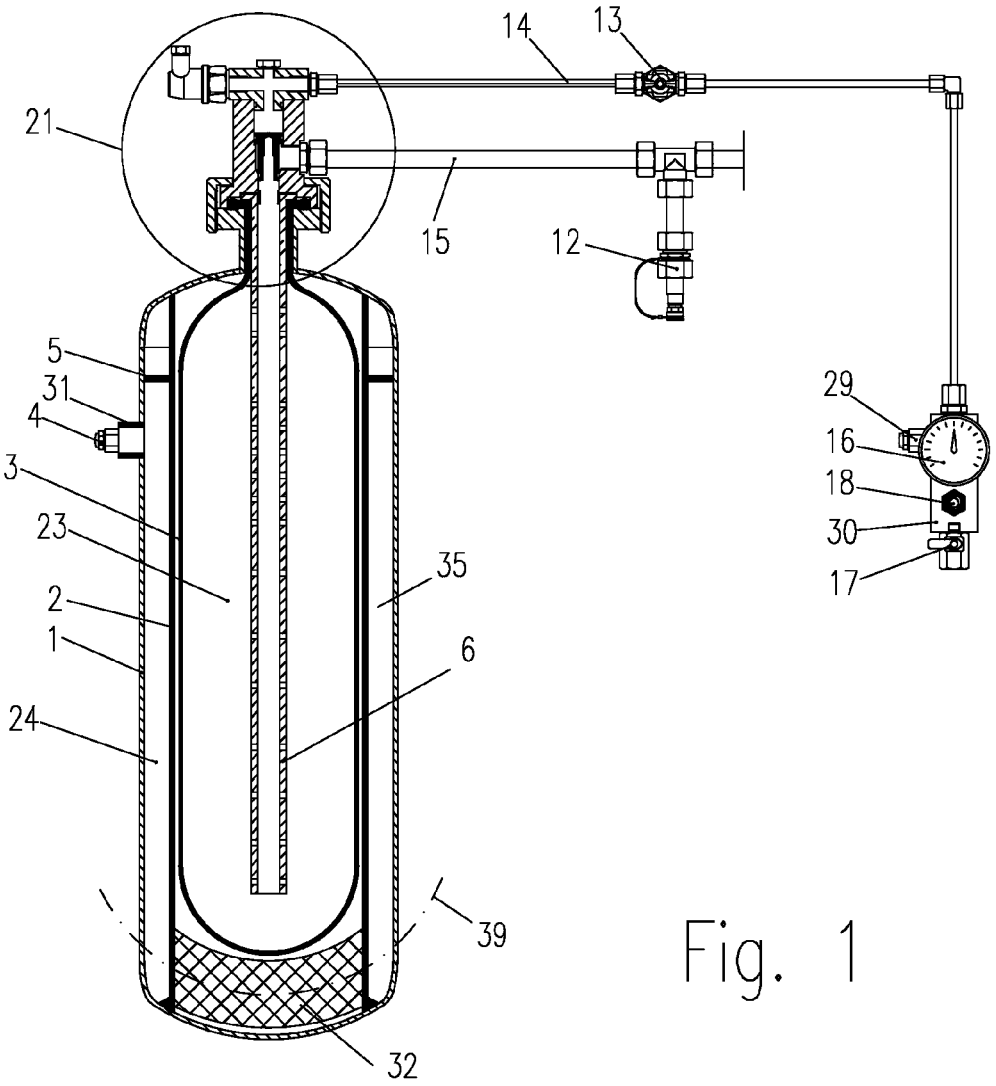

This application claims the benefit and priority of European Patent Application No. 11154772.5, filed Feb. 17, 2011. The entire disclosure of the above application is incorporated herein by reference.

FIELD

The invention relates to a vibration-safe attitude-independent protective device.

BACKGROUND AND SUMMARY

The term protective device is understood to mean an extinguishing device or a device for dispensing a cooling liquid. Since extinguishing liquids have a cooling effect, the term extinguishing agent is further also understood to mean a coolant. The term protective device refers both to mobile and portable devices such as fire extinguishers and stationary installations.

The invention is applicable wherever a protective device must reliably fulfill its function, even under the effect of vibrations, shocks, temperature fluctuations, acting external forces, forces of inertia and other influences.

This may be the case in moving objects, in particular driving, floating, or flying objects such as vehicles, ships or aircraft. In particular when the inventive protective device is installed in moving objects such as tour busses the functionality of the protective device is ensured even in the case of a change in the spatial attitude of the object, for example an accident (the bus turning over).

However the invention can also be applied to protect stationary objects that transmit vibrations and other effects to the protective device.

Protective devices for dispensing liquids (extinguishing agents or cooling liquids) usually use pressure tanks for storing the extinguishing agent. Pressure tanks are known in which there are elastic extinguishing agent balloons. A propellant gas ejects the extinguishing agent out of the extinguishing agent balloon and/or the pressure tank when released.

Various fire extinguishing installations are known for vehicles. For example EP 1 500 412 B1 describes a device for fighting fires in a motor vehicle, in particular a commercial vehicle, with an extinguishing liquid that is held in a state of readiness, a pressure source, and a spraying unit that serves to bring the extinguishing liquid to the scene of the fire using the pressure from the pressure source. The solution is characterized in that the extinguishing-pressure source is formed by the plant air that is present in one or more air reservoirs for vehicle operation in a vehicle, it being the case that additional feed pressure is applied to the extinguishing liquid in the case of a fire.

U.S. Pat. No. 5,984,016 A likewise describes a fire extinguishing installation for a vehicle, where a tank is securely installed in the vehicle and extinguishing lines lead to fire-extinguishing nozzles in various areas of the vehicle. An air tank provides for the corresponding compressed air to be discharged to the nozzles.

U.S. Pat. No. 4,889,189 describes a fire-extinguishing mechanism, where a bladder is arranged in a container and holds a liquid, a gas that is also arranged in a bladder that is present below the liquid acting against this liquid and discharges it out of the tank that surrounds the liquid.

Fire-extinguishing installations are known with fire-extinguishing tanks in which elastic extinguishing agent balloons are arranged.

DE 946 684 describes a fire extinguisher with a pressure tank in which a bag is disposed that contains a foam-generating agent. When a gas cartridge above it is opened this leads to the bag being destroyed and an extinguishing liquid exiting into an extinguishing line. The fire-extinguishing process therefore presupposes the destruction of a bag by mechanical forces.

DE 28 38 341 describes an extinguishing agent balloon for fire extinguishers, in whose rigid interior a container made from an elastic metal or rubber is arranged, one container being filled with an extinguishing agent and the other with a compressed gas and a pressure accumulator being arranged outside the container.

Between the containers a screen body is present that prevents arbitrary expansion of the elastic container.

WO 98/13292 A1 describes a pressure tank in which a liquid is arranged in an elastic liquid container. This elastic liquid container can also serve as a seal. It can be arranged in a rigid container that represents a lateral boundary. This liquid-permeable component is not elastic. Also no elastic fluid-permeable component is arranged on a fluid-permeable part or on the floor of the pressure tank. An extinguishing agent for a fire-extinguishing installation is not described in this document.

U.S. Pat. No. 3,974,945 describes a container for a liquid in which an elastic container is disposed, the liquid being dispersed through an opening. The elastic container that does not represent any extinguishing agent balloon is in part formed as a seal.

GB 2 431 455 A describes a pressure tank in which an elastic liquid container is arranged, the elastic liquid container being filled with an extinguishing liquid and being surrounded by a propellant gas. Part of the elastic extinguishing agent balloon is formed as a seal. Stabilizers, elastic fluid-permeable components cannot be derived from the document.

DE 102 29 011 A1 describes a fire extinguisher, in particular a fire-extinguishing device that can be carried by hand for fighting a fire preferably in aircraft. The fire extinguisher exhibits a mixing chamber arranged at the container in which the extinguishing agent and the propellant gas can be combined and the extinguishing agent and the propellant gas can be expelled into the open in a nozzle connected to the mixing chamber.

In the extinguishing agent balloon itself a hose is arranged with helical windings in which the extinguishing agent is situated. Around the hose the propellant gas is disposed that drives the extinguishing agent out of the hose. By stabilizing the hose or the elastic extinguishing agent balloon a certain stability of the hose material is assumed or that the propellant gas surrounding the extinguishing agent balloon provides the requisite stability.

Disadvantages of these solutions are that when fitting such extinguishing agent balloons on vibrating objects to be protected, when changing the attitude of the extinguishing agent balloon that is connected to a moving object to be protected and/or on a deformation of the outer extinguishing agent balloon it is not guaranteed that the functions will be preserved.

By vibrations and forces acting on the extinguishing agent balloon and/or a change in attitude as they can be encountered for example when using them on a machine or in a means of transportation, in the case of known solutions the elastic inner extinguishing agent balloon can rub against surrounding parts and thus experience wear and be damaged. Similar effects can occur as a result of changes in volume of the elastic extinguishing agent balloon due to temperature changes if the fluid contained therein expands or contracts. If a fluid that cannot be compressed or can be compressed only little such as water is stored in the elastic extinguishing agent balloon and the device is to be used in a greater temperature range of e.g. 4° C. to 90° C., then either an expansion space must be present between the elastic inside container and the non-elastic outer pressure tank or the outer container must be of an extremely pressure-safe design. However such a free space would make possible the undesired relative movements between the inner elastic extinguishing agent balloon and the outer non-elastic container.

It is therefore the objective of the invention to develop a simple protective device for mobile and stationary objects and apparatus that guarantees discharge of the extinguishing agent as intended even under the influences of vibrations, shocks, temperature fluctuations, forces of inertia and changes in attitude, among others.

SUMMARY

This objective is achieved by a device with a pressure tank (1) in which the elastic extinguishing agent balloon (3) filled with an extinguishing agent (23) and the propellant gas (24) surrounding the elastic extinguishing agent balloon (3) are arranged, the elastic extinguishing agent balloon (3) bordering onto a fluid permeable component (32), wherein the elastic fluid permeable component (32) is arranged opposite the opening of the pressure tank (1) on the floor or on a fluid permeable part (28) of the pressure tank (1), the elastic fluid permeable component (32) fixating the elastic extinguishing agent balloon (3).

The inventive solution provides a vibration-safe and attitude-independent protective device that includes a pressure tank, an elastic extinguishing agent balloon filled with an extinguishing agent, a propellant and a fluid-permeable elastic component.

Inside the pressure tank there is an elastic extinguishing agent balloon, for example made of rubber, silicone, PVC etc., in which there is the extinguishing agent or the coolant. The extinguishing agent balloon can be of any shape and can be adapted to the shape of the pressure tank. The extinguishing agent balloon that can be designed as a balloon, a bladder or a flask is provided with an opening so that the extinguishing agent can be introduced and exit.

A propellant in a propellant volume, e.g. propellant gas or compressed air or agents produced pyrotechnically, has the task of expelling the extinguishing agent out of the elastic extinguishing balloon when the pressure tank is released and opens.

The elastic extinguishing agent balloon borders on at least one elastic component that is permeable to a propellant. The permeability of the elastic component for propellants makes it possible for the propellant to have an effect on the elastic extinguishing agent balloon for expelling the extinguishing agent. In its state of operational readiness the elastic inner extinguishing agent balloon is spatially fixed in the pressure tank by the bordering elastic component and the non-elastic spatial separator that is propellant permeable.

In the further descriptions the term "propellant permeable" is also referred to more generally as "fluid permeable" (gases, liquids).

By state of operational readiness, the operating state, the functionally ready state of the device, the closed propellant container with the propellant ready for use and the filled extinguishing agent balloon are understood.

The elastically deformable component can include an elastic material like foam material, metal wool or other materials or a resilient mechanism. The outside shape of this component is matched to the shape of the extinguishing agent balloon and/or the inner shape of the pressure tank. It can be designed as a removable part or designed connected to the pressure tank and/or with the extinguishing agent balloon. A multi-part design is another solution.

An embodiment is a component that comprises the entire surface of the extinguishing agent balloon that fixates the elastic extinguishing balloon in the operating state. Even parts that partly bound the elastic extinguishing agent balloon represent a solution.

It is essential that the surface of the elastic extinguishing agent balloon that is acted on by the largest force effects in the case of temperature-dependent changes in volume, or e.g. by impacts, shocks, vibrations and the effect of forces of inertia and gravitational forces, is bounded by the elastically deformable component. A favorable arrangement of the elastic component in the case of cylindrical shape of the elastic extinguishing agent balloon and its fixation in a cylindrical non-elastic pressure tank is the shape as a cylindrical disk consisting of an elastic propellant-permeable plastic.

The task of the elastic component, due to its deformability or its resilient property, is to exert restoring or tracking forces on the elastic extinguishing agent balloon at the contact points of the elastic component with the elastic extinguishing agent balloon.

This produces the advantage that on the one hand an increase or decrease in volume of the extinguishing agent as a result of temperature fluctuations can be compensated by deforming the elastic component without the extinguishing agent balloon being damaged or destroyed in the case of an expansion of the extinguishing liquid by bordering fixed interfering components such as holes in the spatial separators. Another advantageous effect is that the extinguishing agent balloon, as result of the restoring or tracking forces that permanently act on it and are caused by the elastic component, is permanently fixed free of friction and wear in its surroundings in the case of vibrations, impact and shocks and during changes in attitude.

A further advantage is that due to the elastic component the effect of interfering forces such as forces of inertia on the elastic extinguishing agent balloon are reduced in that the interfering forces are calculated in advance and a corresponding restoring force is generated by the deformation of the elastic component.

This makes possible a temperature-independent operation of the pressure tank of the protective device without any additional safety measures and the use of the inventive protective device even in the case of a change in the spatial attitude of the pressure tank and guarantees that almost 100% of the extinguishing agent is discharged. This represents an advantage for example when the inventive protective device is installed in engine compartments of tour busses and in forestry machines, machine tools, wind generators, water craft and agricultural machines.

To design the inventive protective device in a simple manner, part of the elastic extinguishing agent balloon in the opening is designed as a sealing element. This element can have various shapes like e.g. similar to the topology of an O ring, an x ring or a cone.

When the pressure tank is closed, the extinguishing agent balloon is fixated between the extinguishing agent balloon connector and the housing as a result of its integrated sealing element.

The sealing parts, the seal, the pressure tank lid with its sealing face, the pressure tank connector with its sealing face, are arranged such that they simultaneously close off the pressurized propellant, e.g. gas, and the liquid extinguishing agent in the pressure means tank and in the extinguishing agent balloon against the surrounding atmosphere. This seal type simultaneously keeps two pressurized fluid types separate from each other and seals both with respect to a pressureless atmosphere.

It is advantageous to limit the attitude of the extinguishing agent balloon in the pressure tank by means of a fluid permeable spatial separator and at least one fluid permeable elastic component.

The spatial separator also serves to form the propellant volume. The containment fixates the elastic extinguishing agent balloon in the pressure tank in the operating state.

The volume of that part of the fluid permeable elastic component filled with a propellant here forms a partial volume of the propellant volume.

An advantageous design is the arrangement of the fluid permeable spatial separators as a dimensionally stable fluid permeable part, e.g. in the form of perforated sheet metal. The fluid permeability can be implemented by various shapes of openings in this part. These can be round, elongated, regular and different holes.

In the case of a cylindrical shape of the extinguishing agent balloon and its fixation in the cylindrical pressure tank, an advantageous design of the bounding separator is a dimensionally stable circular piece of sheet metal. The elastic component is then advantageously a cylindrical foam disk.

The circular sheet metal can be arranged at a predetermined level in the pressure tank, the elastic fluid permeable component in the shape of a cylindrical foam disk being on the fluid permeable part and representing the boundary to the elastic extinguishing agent balloon.

In this design variation the extinguishing agent balloon with the extinguishing liquid is positioned on the walls of the pressure tank and is supported from below by the fluid permeable elastic component that rests on the fluid permeable sheet metal. The propellant is disposed in that part of the pressure tank that is separate by the sheet metal and in the fluid permeable elastic part.

A further advantageous design of the fluid permeable spatial separators can be designed as a stabilizer. The stabilizer can be a perforated pipe that is arranged along the wall of the pressure tank. The perforation can be in the form of round, elongated, regular and different holes. The pipe can also be slotted or represent a wire-like device. It is decisive that the stabilizer represents a dimensionally stable fluid permeable enclosure that keeps the extinguishing agent balloon stable in its center. In a preferred embodiment the stabilizer is firmly connected to the floor of the pressure tank, for example welded or soldered, and can in addition be held stationary with fixtures to the wall of the pressure tank.

The extinguishing agent balloon is inserted into the empty pressure tank through the pressure tank connector. The seating and sealing face, of particular design, of the extinguishing agent balloon, for example as an O ring, fits snugly into the groove of the pressure tank connector and pressed against with the housing of the control unit and by means of a cap nut of the tank connector in a fluid tight manner.

In the flask neck, additionally one or more flow out pipes provided with openings can be installed. The flow out pipe has the task of enabling, via the control device, the flow out of the extinguishing agent through the openings to the extinguishing line when "squeezing" the extinguishing agent balloon as a result of the propellant pressure on the elastic extinguishing agent balloon. The flow out pipe also has the task of preventing the extinguishing agent balloon from kinking during the extinguishing agent flow-out.

To create a state of readiness, the elastic extinguishing agent balloon introduced into the pressure tank is filled with an extinguishing liquid, e.g. water, foam producing extinguishing agent, chemical extinguishing agent. The filling volume is determined by containing and fixating the extinguishing agent balloon by means of a fluid permeable spatial separator and the elastic fluid permeable component.

The compensating restoring or tracking forces of the fixating and limiting elastic component at the contact points of the elastic component with the extinguishing agent balloon are produced by filling in the extinguishing agent with a pressure of corresponding level. It is filled until there is a sufficient change in the expansion or a change in the attitude of the bordering elastic component. This is the expansion limit of the extinguishing agent balloon. For a design variant with elastic material this means a reduction in volume of the elastic component. Part of the elastic extinguishing agent balloon displaces material of the elastic component. This also reduces the partial volume of the propellant that is present in the fluid permeable elastic component.

The pressure tank is closed. The lid is connected to corresponding flow out devices and release devices for the flow out.

On the pressure tank a propellant is then applied up to operating pressure. The protective device is then ready for use.

The tank lid can then be realized with a control device. The control device contains a release mechanism e.g. for electrically releasing a solenoid valve or an electromagnetic pulse valve or a release mechanism for a pressure-controlled release.

In the case of a pressure-controlled design the pressure tank can be closed by means of a control device in which a differential piston is arranged with an integrated throttle, an extinguishing line and a control line being arranged in the control device. It is advantageous to choose the cross section of the control line to be greater than the cross section of the throttle that is integrated into the differential piston.

In the release case the pressure rapidly drops by opening a heat sensor, for example a temperature dependent closure, and cannot be fed as a result of the small cross section of the integrated throttle in the piston. The differential pressure then acting on the piston moves the piston into the opened position so that the extinguishing agent can reach in the extinguishing line or in the nozzles.

The control line consists of temperature dependent closures such as sprinkler bulbs or fusible link or contains a manual release.

It is advantageous to release the protective device in that the extinguishing agent is released independent from energy by a drop in pressure in a control line filled with a fluid.

In a further advantageous design the extinguishing agent is released by an electric signal at the solenoid valve or an electromagnetic pulse valve.

The electric signal for controlling the solenoid valve can originate from a fire detection control panel with connected fire detectors or at least from a fire detector that operates independently that exhibits sensors for detecting fire parameters such as smoke, temperature, electromagnetic radiation, gases etc. Manual electric release such as with manual call points is also possible.

Advantageously the operating pressures in the pressure tank and in the fluid filled control line are identical.

In an advantageous design pressure load connectors are arranged on the pressure tank for introducing the propellant gas that can be fitted with a check valve.

The propellant, preferably propellant gas consisting of technical gases or air, is permanently maintained under pressure.

The inventive solution has the advantage that when it is used in mobile and in stationary objects when vibrations or other forces act on the extinguishing device, a high degree of operational reliability of the extinguishing device can be assumed that makes it possible to discharge almost 100 percent of the extinguishing agent without any malfunctioning. In addition, the operation of the extinguishing device is independent of the temperature so that no additional safety measures are necessary when the spatial attitude is changed.

The invention is explained below using nine figures and an exemplary embodiment, in which:

DRAWINGS

Figure 2:
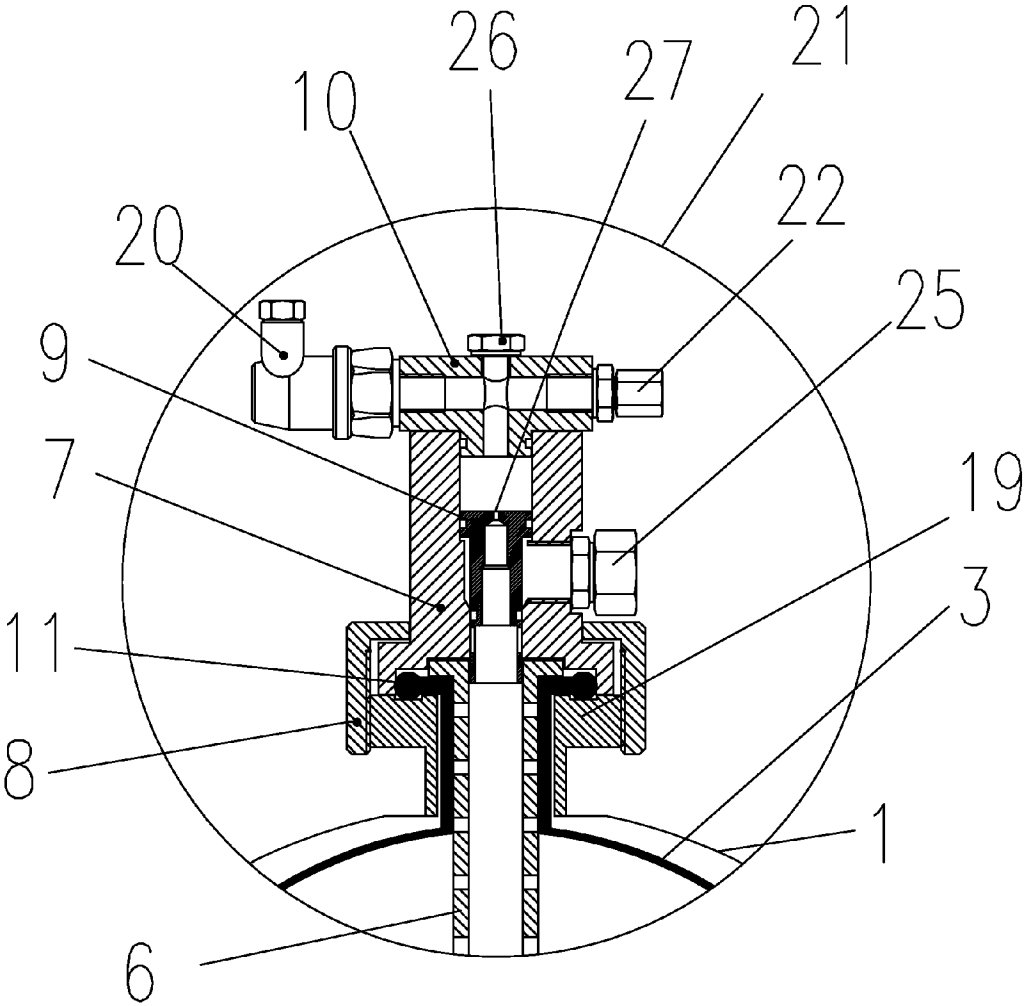
Figure 3:
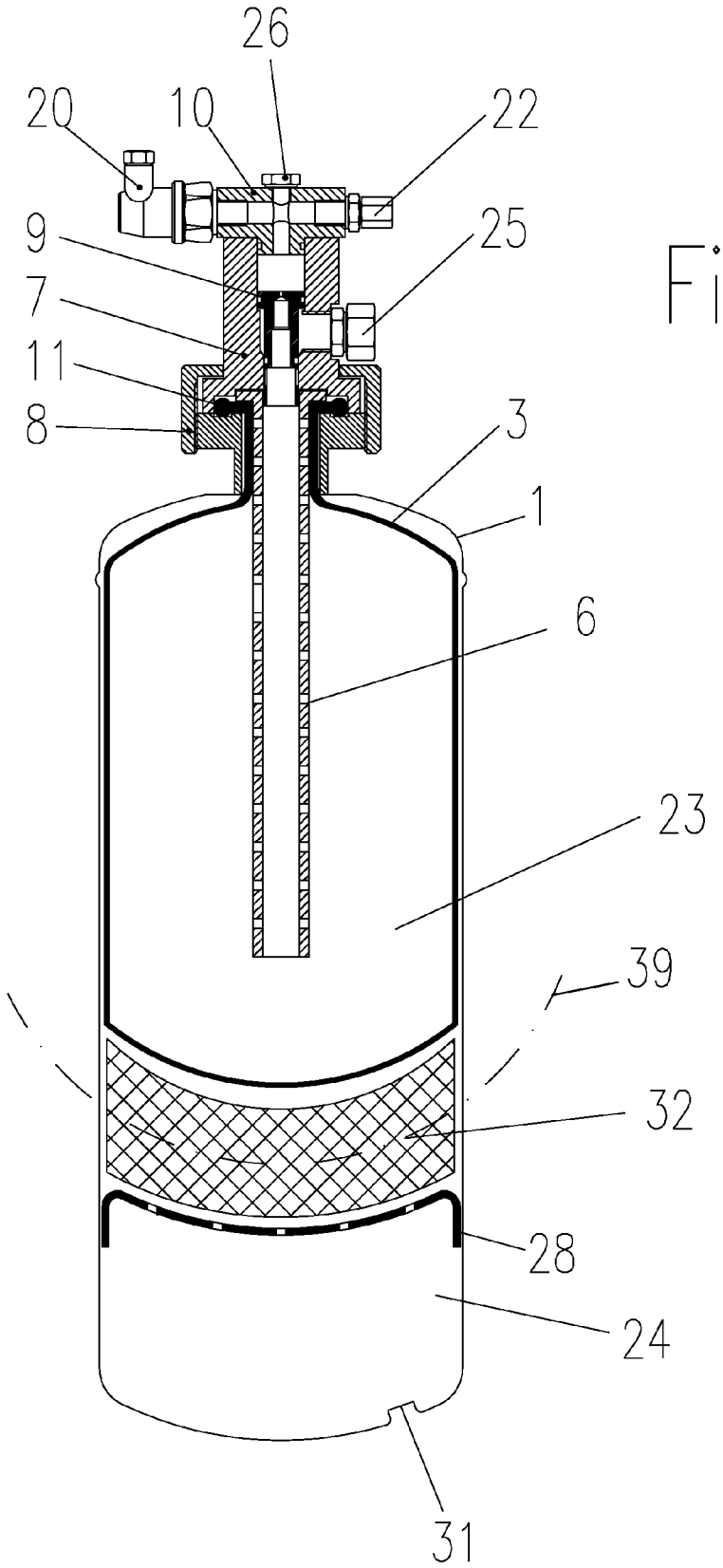
Figure 4:
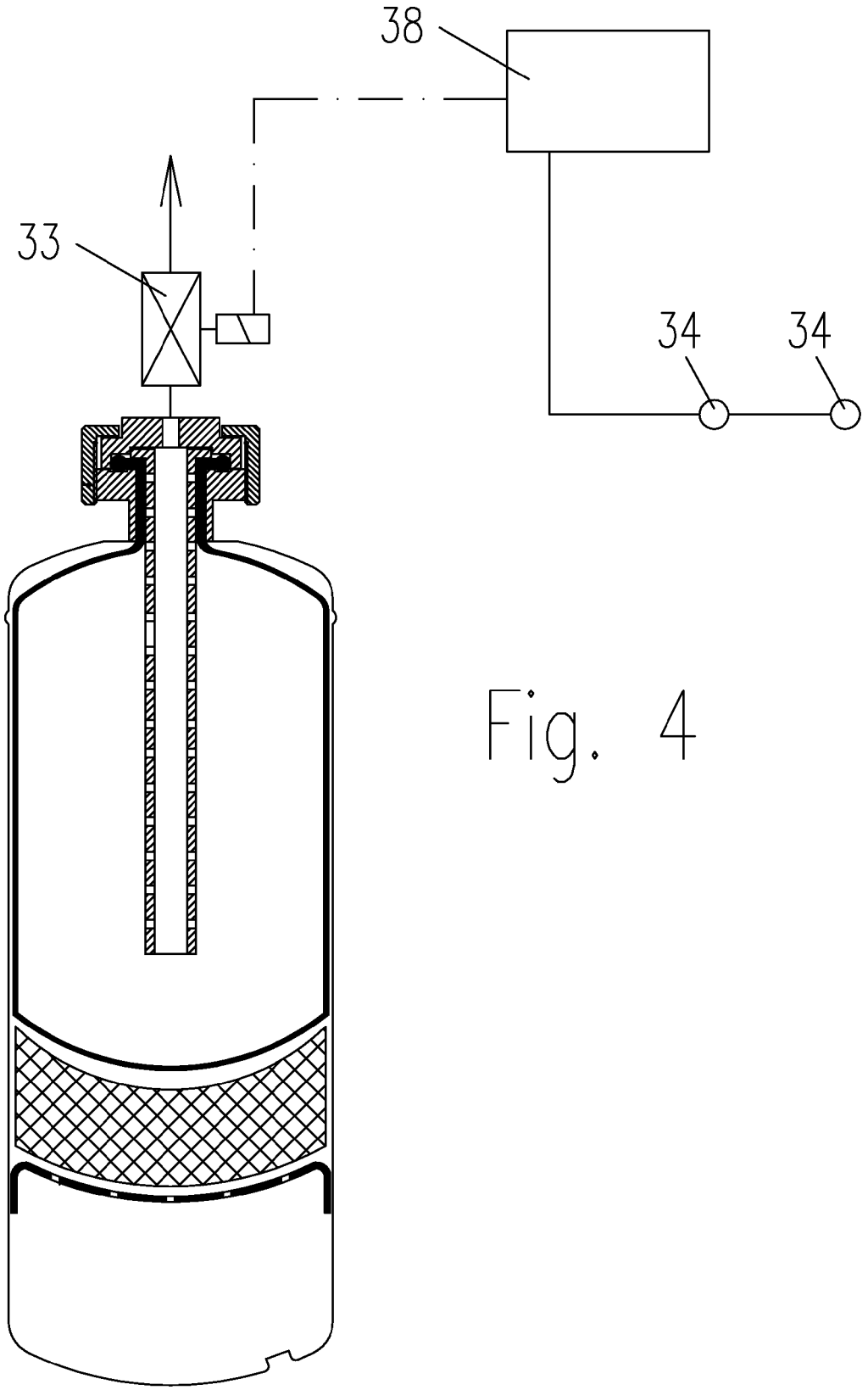
Figure 5:
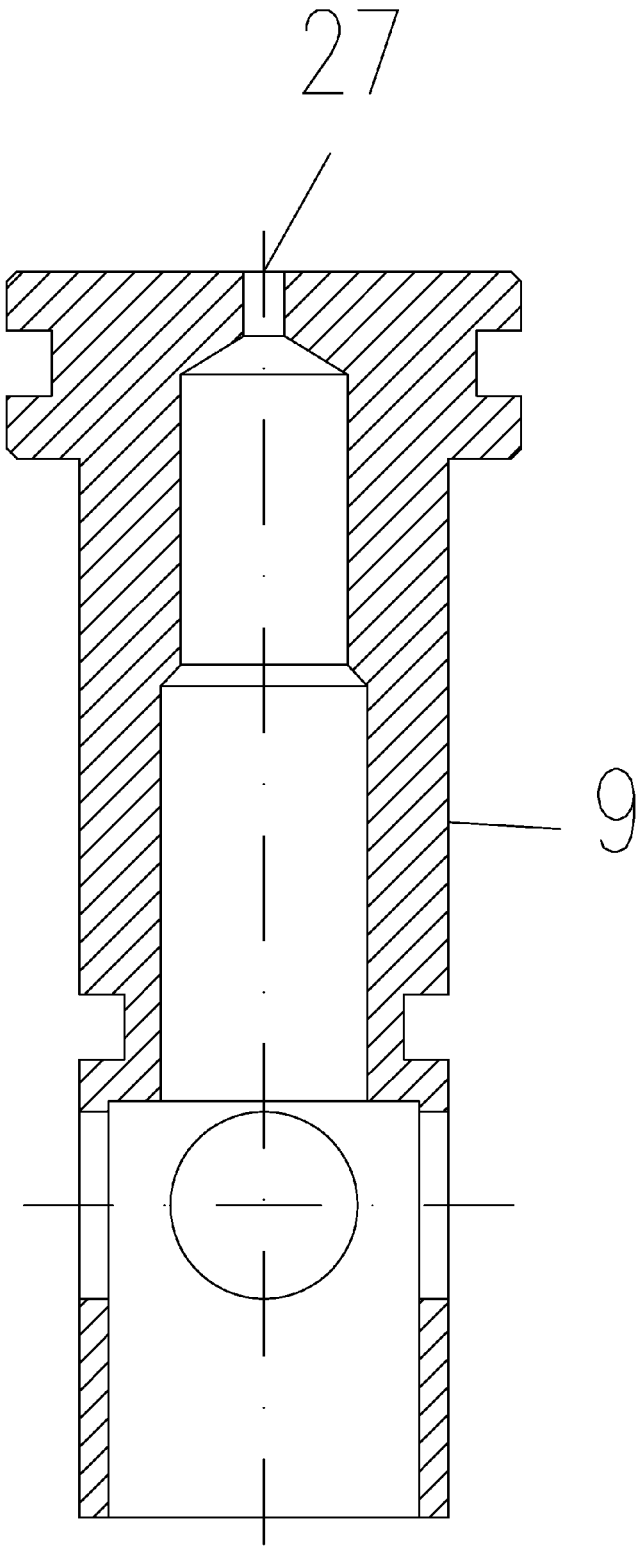
Figure 6:
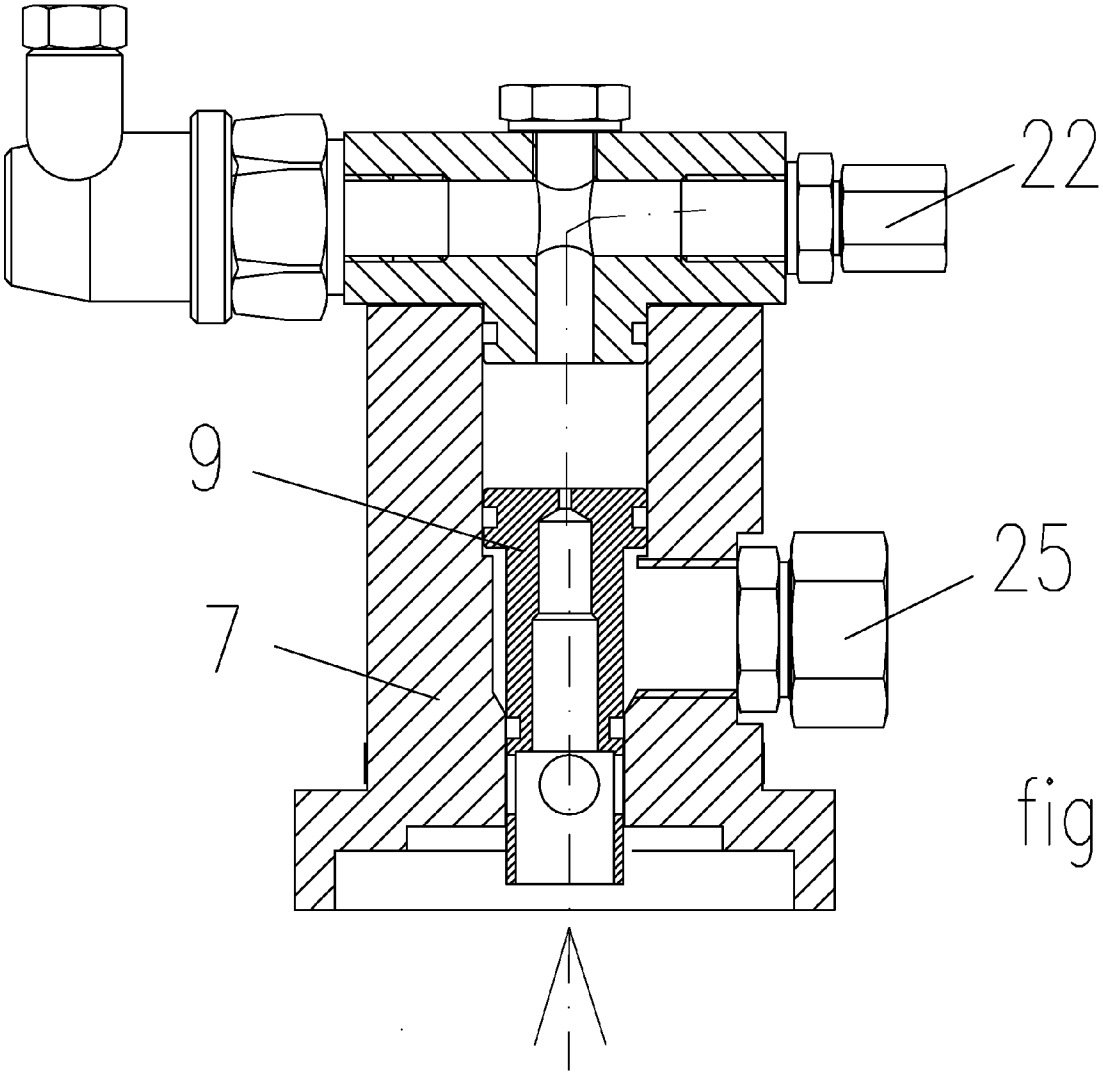
Figure 7:
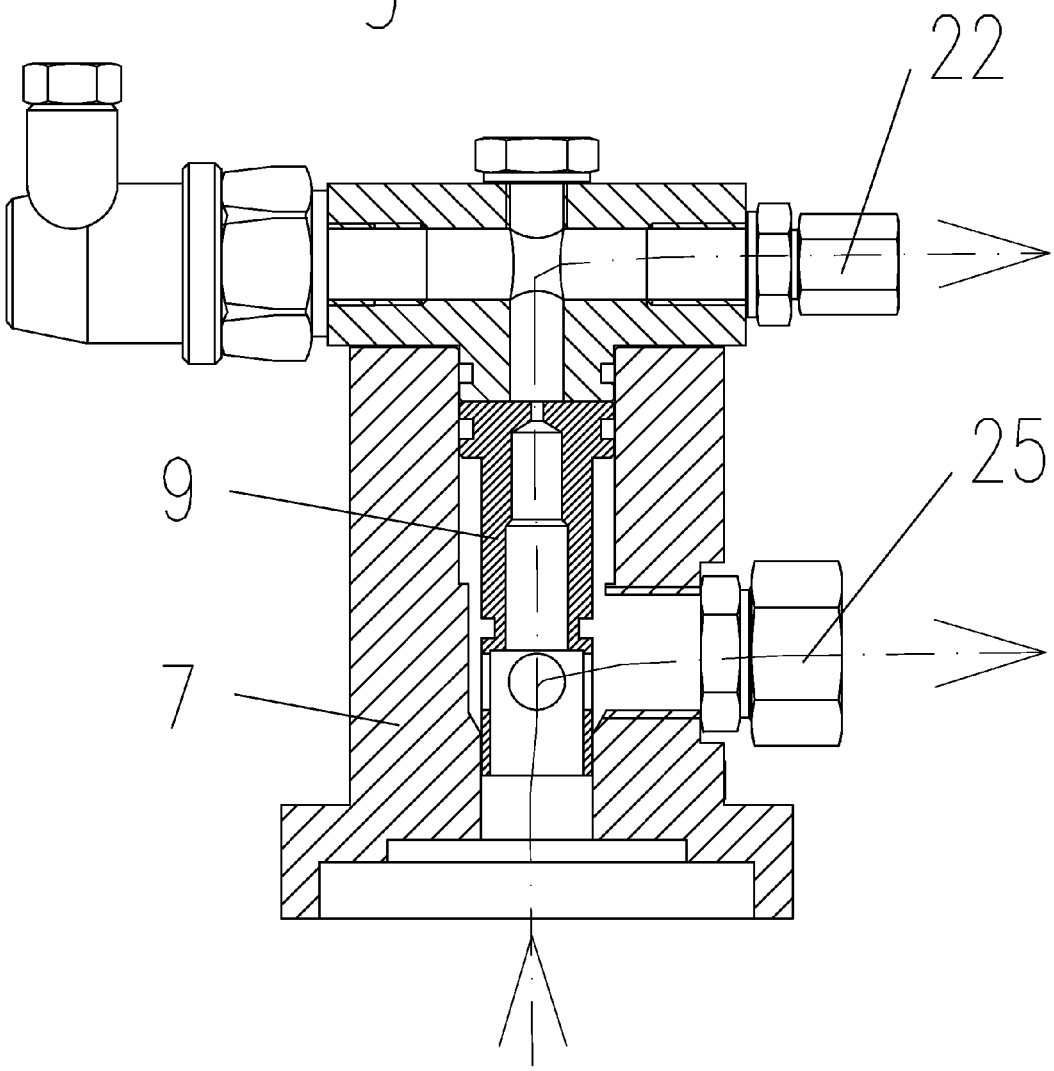
Figure 8:
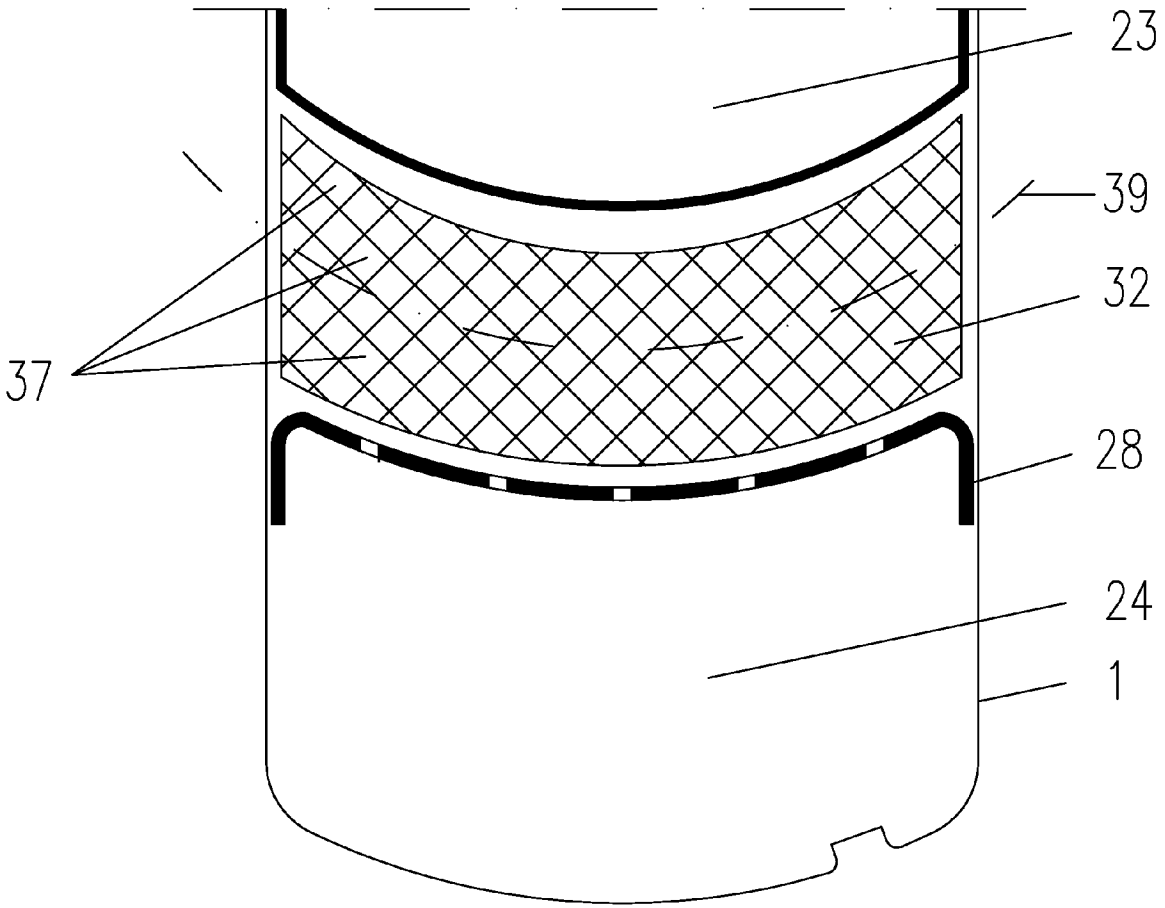
Figure 9:
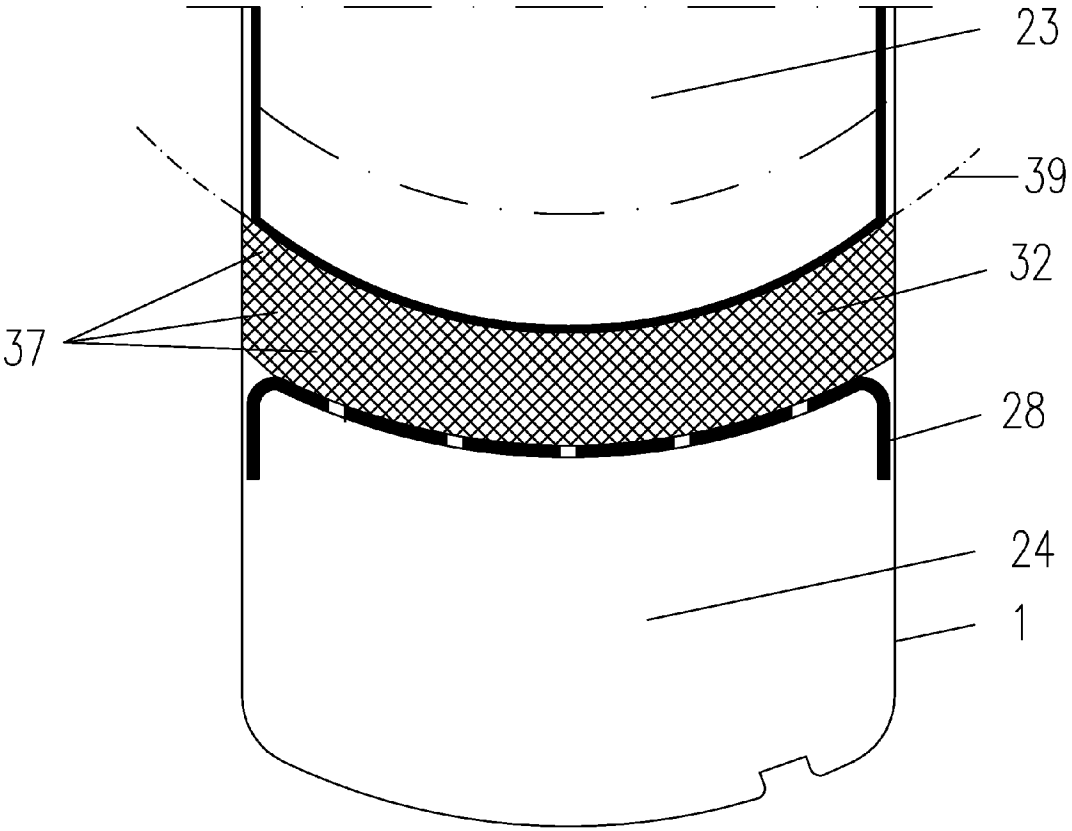

FIG. 1: shows a schematic representation of the extinguishing device with the pressure tank and the extinguishing agent balloon;

FIG. 2: shows details of the pressure-controlled control device of FIG. 1;

FIG. 3: shows the extinguishing agent balloon with the elastic fluid permeable component between the extinguishing agent and the propellant gas;

FIG. 4: shows the extinguishing agent balloon of FIG. 3 with a solenoid valve;

FIG. 5: shows the single representation of the piston;

FIG. 6: shows the representation of the control device 21, closed (ready for operation);

FIG. 7: shows the representation of the control device, open;

FIG. 8: shows details of the elastic component on the fluid permeable part; and FIG. 9: shows details of the elastic component on the fluid permeable part.

DETAILED DESCRIPTION

FIG. 1 shows the inventive protective device of the fire extinguishing installation, consisting of the pressure tank 1 in which the extinguishing agent balloon 3 is arranged within the stabilizer 2 and is supported by an elastic fluid permeable component 32. The extinguishing agent balloon 3 in which the extinguishing agent 23 is situated is surrounded by a propellant gas 24 which is present both in the volume separated by the stabilizer 2 and in the elastic component 32 and fixates the extinguishing agent balloon 3 together with the elastic component 32. The propellant gas 24 is introduced into the pressure tank 1 through the pneumatic connector socket 4. The stabilizer 2 is connected to the pressure tank 1 using the fixations 5. The pressure tank 1 is closed by the control device 21 from where the control line 14 and the extinguishing line 15 lead to the instruments. In the example in the control line 14 a heat sensor 13 and a manual release 17 are disposed. It consists of a safety valve 29, the pressure gauge 16, the filling valve 18, and the housing 30. The extinguishing line 15 leads to the extinguishing nozzles 12, only one extinguishing nozzle 12 being shown. Furthermore a flow out pipe 6 having openings projects into the extinguishing agent balloon 3.

To establish operational readiness, the elastic extinguishing agent balloon 3 introduced into the pressure tank 1 is filled with an extinguishing liquid 23 such as e.g. water, a foam producing extinguishing agent or a chemical extinguishing agent. Due to the containment and fixation of the extinguishing agent balloon 3 in the fluid permeable stabilizer 2 and due to the elastic fluid permeable component 32 in the shape of a cylindrical foam part, the filling volume of the extinguishing agent balloon 3 that the extinguishing agent balloon 3 reaches at its expansion limit 39 at the elastic component 32 is determined.

The stabilizer 2 also serves the function of spatial separators.

An extinguishing agent 23 is filled in until there is a sufficient reduction in volume of the bordering elastic component 32. This reduces the partial volume 37 of the propellant 24 that is situated in the fluid permeable elastic component 32. By compressing the elastic component 32, restoring or tracking forces are produced that act in the contact points of the elastic component 32 with the extinguishing agent balloon 3. The elastic component 32 thus fixates the extinguishing agent balloon 3.

The extinguishing agent balloon 3 with the extinguishing liquid 23 is surrounded by the propellant volume 35.

The operating state of the extinguishing device is produced in that the pressure tank 1 is closed with the control device 21 and then the propellant 24, preferably air, is applied via the pneumatic connector socket 4 up to operating pressure. The protective device is thus ready for use.

FIG. 2 shows the pressure controlled control device 21 in detail. Inside the pressure tank 1 the extinguishing agent balloon 3 is arranged in the shape of a flask. Part of the extinguishing agent balloon 3 is provided in the opening with the surface topology of an O ring as a sealing element 11. This sealing element 11 is situated between the tank connector 19 and the housing 7 and is fixated by these. The flow out pipe 6 is arranged on the inside, the housing 7 and the tank connector 19 being screwed together by means of the cap nut 8. The differential piston 9 with the throttle 27 is positioned in the housing 7. The lines 14, 15 are mounted on the safety valve 29 by connectors 22, 25, the housing 7 being closed by a control cover 10 with a vent screw 26 and a pressure monitoring switch 20 being connected to the control cover 10.

FIG. 3 shows in a further design variant of the extinguishing device how the extinguishing agent balloon 3 can be arranged in the pressure tank 1, there being situated in the pressure tank 1 a diaphragm in the form of a fluid permeable part 28 on which the elastic fluid permeable component 32 is arranged. The propellant gas 24 is present in the volume below the fluid permeable part 28 and in the fluid permeable component 32. In the operating state it permanently acts against the extinguishing agent balloon 3 with the extinguishing agent 23.

To establish the operational readiness, the elastic extinguishing agent balloon 3 introduced into the pressure tank 1 is filled with an extinguishing liquid 23. Due to the containment and fixation of the extinguishing agent balloon 3 in the pressure tank 1 and by means of the fluid permeable part 28, a dimensionally stable metal sheet, and the elastic fluid permeable component 32, a cylindrical foam disk, the filling volume is determined.

Extinguishing agent 23 is filled in until, by pressing, there is a sufficient change in volume or restoring force by the bordering elastic component 32. By filling the extinguishing agent balloon 3 part of the volume of the elastic component 32 compressed, this reduces the partial volume of the propellant which is situated in the fluid permeable elastic component 32. As a result of the compressed elastic component 32, restoring and tracking forces act at the contact points of the elastic component with the extinguishing agent balloon 3.

The operating state of the extinguishing device is created in that the pressure tank 1 is closed using the control device 21 and then the propellant 24 is applied via the pneumatic connector socket 4 up to operating pressure. The protective device is thus ready for use.

FIG. 4 shows a solenoid valve 33 as the closure of the pressure tank 1.

The extinguishing agent 3, water, is released by the solenoid valve 33. The electric signal for driving the solenoid valve 33 originates from the fire detection control panel 38 with connected fire detectors 34. It is also possible to have a fire detector 34 that operates independently and that exhibits sensors for detecting fire parameters such as smoke, temperature, electromagnetic radiation, gases etc. Manual electric release such as with manual call points is also possible.

FIG. 5 shows the differential piston 9 with the throttle 27.

The function of the control device 21 is illustrated in FIGS. 6 and 7, FIG. 6 showing the control device in the closed state, that is ready to operate, and FIG. 7 the control device in the open state, that is during the extinguishing process, where the differential piston 9 is being pressed upward and the extinguishing agent 23 flows via the connector 25 into the extinguishing line 15 to the extinguishing nozzles 12.

The system is released in this way:

In the case of a fire: by opening the manual release 17 or by opening the control line 14 by means of a heat sensor 13 the pressure in the control line 14 is released fast. The greater cross section of the control line 14 cannot be supplied through the throttle 27 built into the piston 9, the pressure differential thus forces the differential piston 9 to move into that position that opens the passage for the extinguishing agent at the connector of the extinguishing line 25.

The route of the extinguishing agent 23 from the extinguishing agent balloon 3 to the nozzles 12 is thus released.

The pressure of the propellant 24 that is present at the extinguishing agent balloon 3 penetrates the stabilizer 2 or the diaphragm 28 and presses the extinguishing agent balloon 3 toward the flow out pipe 6.

The extinguishing agent 23 reaches the extinguishing nozzles 12, the extinguishing process being thus carried out.

FIGS. 8 and 9 show the elastic component 32 on the fluid permeable part 28 in the pressure tank 1 acting against to the extinguishing agent balloon 3 with the extinguishing liquid 23, the propellant gas 24 penetrating the elastic component 32 and forming with it a partial volume 37 of the propellant gas volume 35.

Here FIG. 8 shows the filling state of the extinguishing agent balloon 3 before it reaches the elastic component 32 with the partial volume 37 of the propellant gas volume 35.

FIG. 9 shows the state in which the extinguishing agent balloon 3 reaches its expansion limit 39 on filling. The elastic component 32 with the partial volume 37 is deformed in the process.

LIST OF REFERENCE SYMBOLS

1 pressure tank
2 stabilizer
3 extinguishing agent balloon
4 pneumatic connector socket
5 fixation
6 flow out pipe
7 housing
8 cap nut
9 differential piston
10 control cover
11 seal
12 extinguishing nozzle
13 heat sensor
14 control line
15 extinguishing line
16 pressure gauge
17 manual release
18 filling valve
19 tank connector
20 pressure monitoring switch
21 control device
22 connector control line
23 extinguishing agent
24 propellant gas
25 connector extinguishing line
26 vent screw
27 throttle
28 fluid permeable component
29 safety valve
30 housing
31 pressure load connector
32 elastic component
33 solenoid valve/electromagnetic pulse valve
34 sensors/fire detector
35 volume of propellant
36 fluid permeable spatial separator
37 partial volume
38 fire detection control panel
39 extension limit of 3 during the filling

The invention claimed is:

1. A device comprising;

a pressure tank (1) in which an elastic extinguishing agent balloon (3) filled with an extinguishing agent (23) and a propellant gas (24) surrounding the elastic extinguishing agent balloon (3) are arranged, the elastic extinguishing agent balloon (3) bordering onto an elastic fluid permeable component (32), wherein the elastic fluid permeable component (32) is arranged opposite an opening of the pressure tank (1) on a floor or on a fluid permeable part (28) of the pressure tank (1), the elastic fluid permeable component (32) fixating the elastic extinguishing agent balloon (3).

2. The device according to claim 1, wherein the elastic extinguishing agent balloon (3) is bounded by a stabilizer (2).

3. The device according to claim 1, wherein part of the elastic extinguishing agent balloon (3) is formed as a seal (11).

4. The device according to claim 3, wherein the seal of the extinguishing agent balloon (3) together with the pressure tank (1) and a closure separates two compressed fluids (24, 23) from each other and seals from a pressure-less atmosphere.

5. The device according to claim 3, wherein the seal (11) is formed as an O ring.

6. The device according to claim 1, wherein the pressure tank (1) is closed by means of a control device (21) in which a differential piston (9) is situated and where an extinguishing line (15) and a control line (14) are arranged on the control device (21).

7. The device according to claim 6, wherein the extinguishing agent (23) is released by a drop in pressure in the fluid-filled control line (14).

8. The device according to claim 7, wherein an operating pressure in the pressure tank (1) is identical to that in the fluid-filled control line (14).

9. The device according to claim 1, wherein the pressure tank (1) is closed by means of a solenoid valve (33) and the extinguishing agent (23) is released by an electric signal to the solenoid valve (33).

10. The device according to claim 7, wherein heat sensors (13) and a manual release (17) are arranged in the control line (14) and extinguishing nozzles (12) are arranged in the extinguishing line (15).

* * * * *

UNITED STATES PATENT AND TRADEMARK OFFICE

CERTIFICATE OF CORRECTION

PATENT NO. : 9,004,189 B2
APPLICATION NO. : 13/397850
DATED : April 14, 2015
INVENTOR(S) : Chrysafis Zlatintsis It is certified that error appears in the above-identified patent and that said Letters Patent is hereby corrected as shown below:

Title page, item (30), Foreign Application Priority Data, delete "11154781" and insert --11154781.6-- therefor.

In the Specification:

At column 4, line 67, delete "x" and insert --X-- therefor.

At column 9, line 14, delete "3," and insert --23,-- therefor.

In the Claims:

At column 10, claim number 1, line number 38, delete "comprising;" and insert --comprising:-- therefor.

Signed and Sealed this
Twenty-eighth Day of July, 2015

Michelle K. Lee

Michelle K. Lee
*Director of the United States Patent and Trademark Office*